US005758828A

United States Patent [19]

Takahashi

[11] Patent Number: 5,758,828

[45] Date of Patent: Jun. 2, 1998

[54] CARBONATED SHOWER APPARATUS

[75] Inventor: Masashi Takahashi, Kashiwa, Japan

[73] Assignee: Nippon Tansan Gas Company Limited, Tokyo, Japan

[21] Appl. No.: 574,779

[22] Filed: Dec. 19, 1995

[30] Foreign Application Priority Data

Dec. 22, 1994 [JP] Japan ..... 6-335395

[51] Int. Cl.[6] ..... A62C 11/00; A62C 31/00

[52] U.S. Cl. ..... 239/309; 239/445; 239/446; 239/570; 239/581.1; 239/586; 239/311

[58] Field of Search ..... 239/310, 311, 239/445, 446, 309, 570, 581.1, 582.1, 586, 583; 222/400.7, 400.8; 4/541.1

[56] References Cited

U.S. PATENT DOCUMENTS

| | | | |
|---|---|---|---|
| 2,211,007 | 8/1940 | Funk | 239/311 X |
| 2,540,064 | 1/1951 | Weber | 239/311 X |
| 2,699,731 | 1/1955 | Pollock et al. | 239/318 X |
| 4,735,348 | 4/1988 | Santoiemmo et al. | 222/400.7 X |
| 4,998,836 | 3/1991 | Scripnick | 239/310 X |
| 5,347,665 | 9/1994 | Kumon et al. | 21/541.1 |

*Primary Examiner*—Kevin Weldon
*Attorney, Agent, or Firm*—Lackenbach Siegel Marzullo Aronson & Greenspan, P.C.

[57] ABSTRACT

A carbonated shower apparatus for home use can selectively supply carbonated water in a simple manner and at low cost for bathing, hair washing, pet washing and other purposes. It comprises a mixing water tap unit (1), a carbon dioxide gas supply unit (2), a hose (3), a control valve (4) and a shower head (5). It is characterized in that the mixing water tap unit (1) is of an ordinary type and connected at a side to a cold water path (13) and a hot water path (14) by way of a cold water tap and a hot water tap respectively and at the other side to a water head (16) and the hose (3) to selectively communicate with either of them by way of a two-way valve (15), that the carbon dioxide gas supply unit is arranged at the mixing water tap unit to take out gas from a small gas cartridge (21), reduce the gas pressure and send it out to the consumption side (23) via an outlet port (22), that the hose is connected at the base end thereof to the mixing water tap unit in an ordinary manner and contains therein a small tube (25) having its base end connected to the outlet port, that the control valve has a water through path (41) and a gas through path (42), the water through path being connected at an end to the front end of the hose, the gas through path being connected at an end to the front end of the small tube and at the other end to a nozzle (46) communicating with the water through path and provided at the middle thereof with a valve section (47) and that the shower head is fitted to the control valve and communicating in the inside with the other end of the water through path.

5 Claims, 5 Drawing Sheets

CARBONATED SHOWER APPARATUS

BACKGROUND OF THE INVENTION

1. [Field of the Invention]

This invention relates to a carbonated shower apparatus that can inject carbon dioxide into shower water to provide the user of the apparatus with carbonated shower water.

The effects of carbonated shower water on health have been known as a result of a number of studies including those made by the researchers of Munich University in Germany and of Kawo Co., Ltd in Japan. Such effects include promotion of blood circulation and warming of the body. Carbonated shower water is good not only for the skin but also for the scalp and the hair.

The present invention relates to an apparatus with which a shower can be equipped with a gas bomb to produce carbonated shower water at home.

2. [Prior Art]

Artificially carbonated water has been used for bathing. To produce carbonated water, carbon dioxide gas is discharged from a bomb and dissolved into the water contained in a bath. A number of apparatuses have been proposed to facilitate the operation of producing artificially carbonated water for bathing.

One of the most simple methods for producing carbonated bath water is the use of a solid bubbling agent (tablet) that produces carbon dioxide gas as it is put into water. Such an agent typically contains sodium hydrogen carbonate and an acid that chemically react on each other in the presence of water to produce carbon dioxide gas. Various products of this type are currently marketed by many toiletry manufacturers. It has been proved that a carbon dioxide concentration of 100 ppm in bath water is sufficiently effective for health if the bath tab has a capacity of 150 to 200 liters. (A 50 g tablet good for a single use is typically priced at about 70 cents.)

Japanese Patent Application No. 5-238928 proposes the use of carbon dioxide gas for hair care.

However, a bomb containing pressurized carbon dioxide gas is normally very large, heavy and difficult to handle and, therefore, it is not suited for home use.

A solid bubbling agent for producing carbon dioxide gas has to be thrown into bath water each time the user takes a bath and, since it bubbles out quickly, it is good for only a single person. While carbonated water can effectively astringe cuticle to make hair bright and lustrous if it shows a pH value around 5.5, it can damage hair if the pH is as high as 8.

An apparatus disclosed in the above cited Japanese Patent Application No. 5-238928 and designed to produce carbon dioxide gas for hair care is complicated, costly and, although it is good for a single person or business use, it has reportedly never gained popularity to date.

In view of the recent trend that more people take a shower than a bath and more and more people daily wash hair, there seems to be an ever increasing demand for a shower provided with a mini-cartridge containing carbon dioxide gas that can selectively supply carbonated water through a simple use of a valve particularly if the supplied carbonated water contains dissolved carbon dioxide at a concentration of 100 to 200 ppm and shows a pH value of 5.2 to 5.5.

Therefore, it is an object of the present invention to provide a carbonated shower apparatus for home use that can selectively supply carbonated water in a simple manner and at low cost for bathing, hair washing, pet washing and other purposes in order to exploit the known effects of carbonated water including promotion of blood circulation, warming of the body and skin and hair care.

It is another object of the present invention to provide a carbonated shower apparatus comprising a hose provided with a path for carbon dioxide gas so that a separate hose is not required for feeding carbon dioxide gas.

It is still another object of the present invention to provide a carbonated shower apparatus provided with a control unit disposed near the shower head to control the supply of shower water and carbon dioxide gas.

It is a further object of the present invention to provide a carbonated shower apparatus with which the supply of shower water and carbon dioxide gas can be controlled by means of one or more than one buttons.

It is a still further object of the present invention to provide a carbonate show apparatus with which the supply of shower water and carbon dioxide gas can be controlled by means of a dial.

SUMMARY OF THE INVENTION

According to the invention, the above objects and other objects of the invention are achieved by providing a carbonated shower apparatus comprising a mixing water tap unit, a carbon dioxide gas supply unit, a hose, a control valve and a shower head, characterized in that the mixing water tap unit is of an ordinary type and connected at a side to a cold water path and a hot water path by way of a cold water tap and a hot water tap respectively and at the other side to a water head and the hose to selectively communicate with either of them by way of a two-way valve, that the carbon dioxide gas supply unit is arranged at the mixing water tap unit to take out gas from a small gas cartridge, reduce the gas pressure and send it out to the consumption side via an outlet port, that the hose is connected at the base end thereof to the mixing water tap unit in an ordinary manner and contains therein a small tube having its base end connected to the outlet port, that the control valve has a water through path and a gas through path, the water through path being connected at an end to the front end of the hose, the gas through path being connected at an end to the front end of the small tube and at the other end to a nozzle communicating with the water through path and provided at the middle thereof with a valve section and that the shower head is fitted to the control valve and communicating in the inside with the other end of the water through path.

Preferably, the carbon dioxide gas supply unit has a small gas cartridge fitting port, a closure opening device, a primary gas outlet mechanism and a pressure reducing mechanism of an ordinary type, the pressure reducing mechanism having a valve pin actuating piston consisting of an inner cylinder and an outer cylinder designed to coaxially slide relative to each other within a limit defined by a stopper, the outer cylinder being engaged with a pressure regulating spring, the inner cylinder having at an end surface thereof an abutment section for abutting the valve pin located apart from a gas outflow hole also arranged on the end surface, the inner cylinder also having at the opposite end thereof an opening constantly communicating with a gas passage provided within a sleeve and communicating with the outlet port.

Still preferably, the small tube can withstand the reduced pressure of carbon dioxide gas.

Still preferably, the valve section includes a valve case, a valve rod, a cylinder for slidably receiving the valve rod and a spring disposed within the cylinder to urge back the valve rod, the cylinder transversing the water through path and maintaining gap therein to allow water to flow therethrough, the gas through path passing through the peripheral wall and the axis of the cylinder and being provided at an end thereof with a fitting tube, the other end of the small tube being fitted to the fitting tube, the nozzle 46 being fitted to the other end of the gas through path, the outer end of the valve rod projecting from the valve case to constitute a button section, the valve rod having a connecting section within the valve case to be connected to and communicating with the gas through path of the cylinder.

Still preferably, the valve section includes a valve case, a valve rod and a cylindrical valve body, the valve rod being provided at the outer end thereof with a dial and at the inner end thereof with a spherical body having a connecting section for opening and closing the gas through path, the spherical body being capable of revolving at a given position within the valve case, the cylindrical valve body containing the gas through path axially running therethrough and being disposed within the valve case so as to maintain the gap between the inner wall of the valve case and itself to allow water to flow therethrough, the spherical body of the valve rod being revolvably contained in the valve case with the connecting section disposed coaxially with the gas through path.

When a small high pressure carbon dioxide gas cartridge is fitted to the carbon dioxide gas supply unit of a carbonated shower apparatus according to the invention, the apparatus is ready for use. Carbon dioxide gas flows out of the gas cartridge and gets to the gas through path via the small tube but cannot flow further as the gas through path is blocked by the valve section.

To use the shower, the two-way valve is set to the hose side and the water temperature is regulated by controlling the cold water tap and the hot water tap of the mixing water tap unit. To use carbonated shower water, the gas through path is opened by means of the control valve. Then, carbon dioxide gas bursts out into the water through path by way of the nozzle and becomes dissolved into hot water there to give rise to the effects of a carbonated shower.

As long as the control valve is closed, gas does not flow into the water through path and hence the shower apparatus provides simply hot or cold water.

When the carbon dioxide gas supply unit of a carbonated shower apparatus according to the invention is so configured as to have a small gas cartridge fitting port, a closure opening device, a primary gas outlet mechanism and a pressure reducing mechanism of an ordinary type, the pressure reducing mechanism having a valve pin actuating piston consisting of an inner cylinder and an outer cylinder designed to coaxially slide relative to each other within a limit defined by a stopper, the outer cylinder being engaged with a pressure regulating spring, the inner cylinder having at an end surface thereof an abutment section for abutting the valve pin located apart from a gas outflow hole also arranged on the end surface, the inner cylinder also having at the opposite end thereof an opening constantly communicating with a gas passage provided within a sleeve and communicating with the outlet port, since the gas outlet port can be disposed in an upper area of the sleeve and the cartridge fitting port can be arranged below the mixing water tap unit, a cartridge can be easily and removably fitted in position to the carbon dioxide gas supply unit.

When the small tube of the hose is so designed as to be able to withstand the reduced pressure of carbon dioxide gas, pure water or carbonated shower water can be selected without any trouble because no carbon dioxide gas would leak into the hose as long as the use of pure shower water is selected.

When the valve section is so configured that it includes a valve case, a valve rod, a cylinder for slidably receiving the valve rod and a spring disposed within the cylinder to urge back the valve rod, the cylinder transversing the water through path and maintaining a gap therein to allow water to flow therethrough, the gas through path passing through the peripheral wall and the axis of the cylinder and being provided at an end thereof with a fitting tube, the other end of the small tube being fitted to the fitting tube, the nozzle 46 being fitted to the other end of the gas through path, the outer end of the valve rod projecting from the valve case to constitute a button section, the valve rod having a connecting section within the valve case to be connected to and communicating with the gas through path of the cylinder, the use of pure shower water can be easily switched to that of carbonated shower water or vice versa because the control valve can be manipulated near the shower head.

When the valve section is so configured that it includes a valve case, a valve rod and a cylindrical valve body, the valve rod being provided at the outer end thereof with a dial and at the inner end thereof with a spherical body having a connecting section for opening and closing the gas through path, the spherical body being capable of revolving at a given position within the valve case, the cylindrical valve body containing the gas through path axially running therethrough and being disposed within the valve case so as to maintain the gap between the inner wall of the valve case and itself to allow water to flow therethrough, the spherical body of the valve rod being revolvably contained in the valve case with the connecting section disposed coaxially with the gas through path, the shower apparatus can be operated with ease because the dial maintains its selected position if the user releases his or her hand from it.

Now, the present invention will be described in greater detail by referring to the accompanying drawings that illustrate a preferred embodiment of the invention.

DETAILED DESCRIPTION OF THE PREFERRED EMBODIMENT

Figure 1:
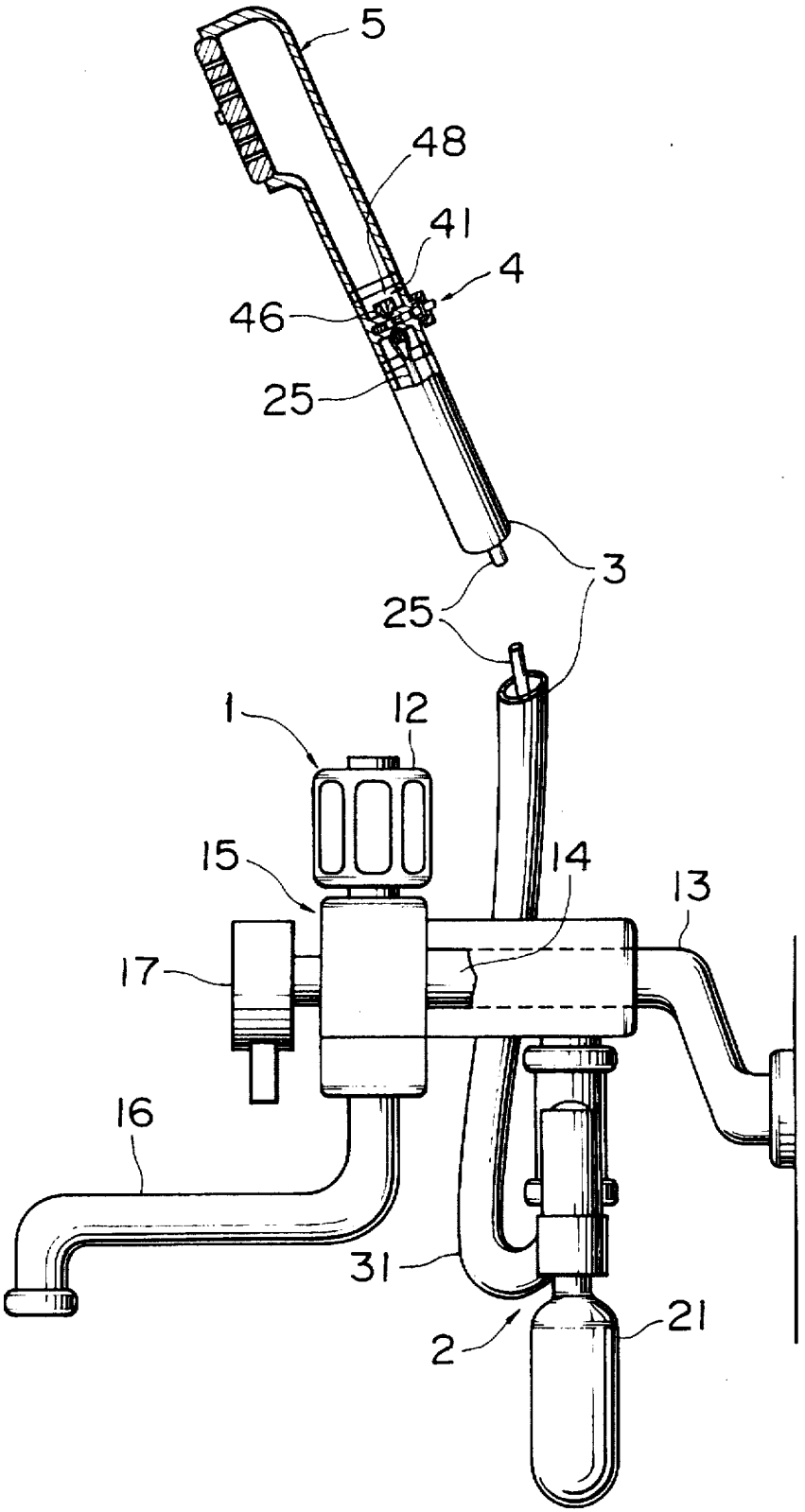
FIG. 1 is a partially cut out lateral view of a preferred embodiment of carbonated shower apparatus according to the invention.
Figure 2:
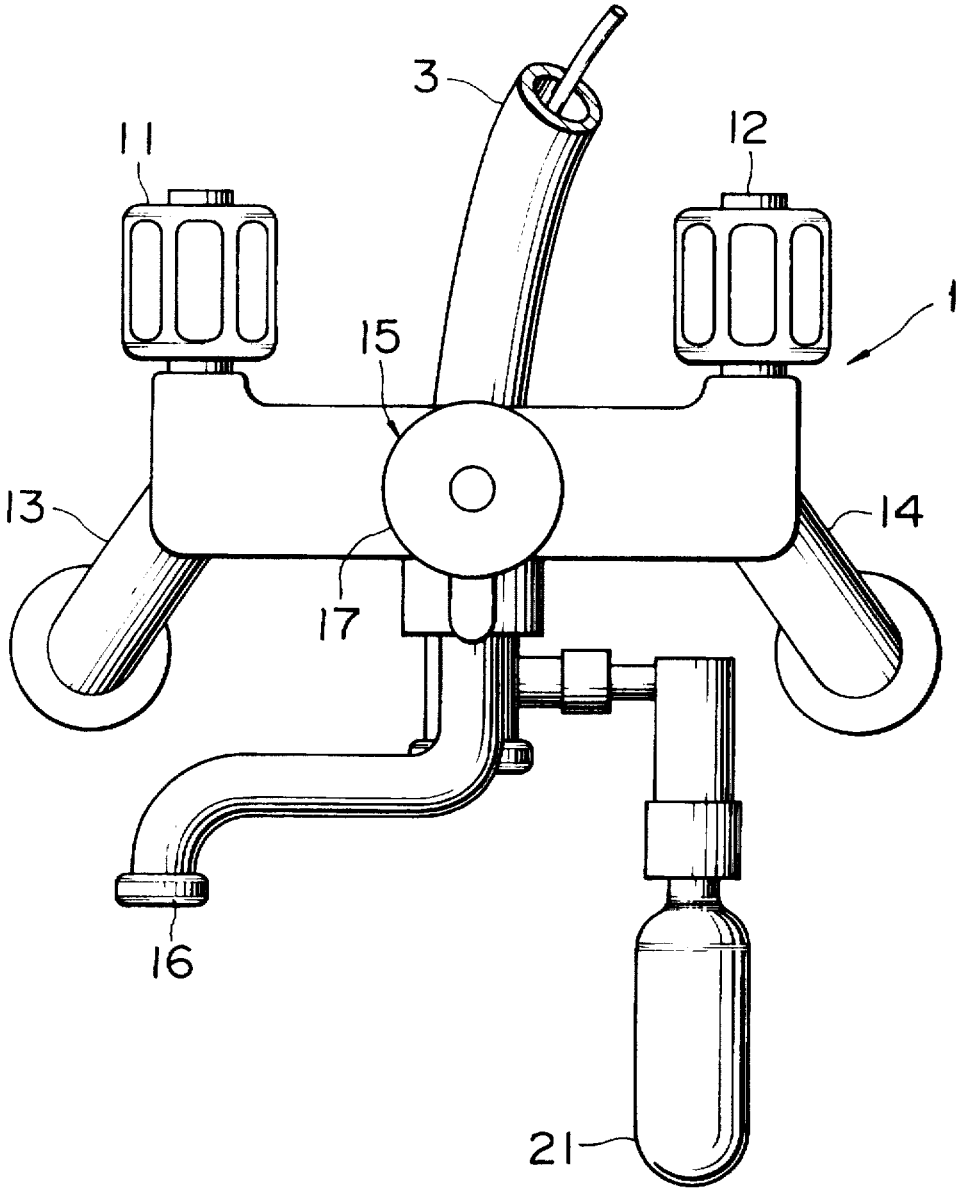
FIG. 2 is a lateral view of the mixing water tap unit and some related components of the embodiment of FIG. 1.

Referring to the accompanying drawings that illustrate a preferred embodiment of carbonated shower apparatus according to the invention, it comprises a mixing water tap unit 1, a carbon dioxide gas supply unit 2, a hose 3, a control valve 4 and a shower head 5.

The mixing water tap unit 1 may be of any ordinary type and is connected at a side to a cold water path 13 and a hot water path 14 by way of a cold water tap 11 and a hot water tap 12 respectively. The mixing water tap unit 1 is also connected at the other side to a water head 16 and the hose 3 to selectively communicate with either of them by way of a two-way valve 15.

The carbon dioxide gas supply unit 2 is also of any ordinary type and designed to take out gas from a small gas cartridge 21, reduce the gas pressure and send it out to the consumption side 23 via an outlet port 22. The carbon dioxide gas supply unit 2 is arranged at the mixing water tap unit 1.

The hose 3 is connected at the base end 31 thereof to the mixing water tap unit 1 in an ordinary manner. The hose 3 contains therein a small tube 24 having its base end connected to the outlet port 22.

The control valve 4 has a water through path 41 and a gas through path 42. The water through path 41 is connected at an end 41 to the front end 32 of the hose 3. The gas through path 42 is connected at an end 44 to the front end 25 of the small tube 24 and at the other end 45 to a nozzle 46 communicating with the water through path 41. It is provided at the middle thereof with a valve section 47.

The shower head 5 is fitted to the control valve 4 and communicating in the inside with the other end 48 of the water through path 41.

As the small gas cartridge 21 is fitted to the carbon dioxide gas supply unit 2 and opened, carbon dioxide gas bursts out of the cartridge and its pressure is reduced by the gas pressure reducing mechanism before it flows through the outlet port 22 and the small tube 24 and gets to the end 44 of the gas through path 42 of the control valve 4.

If the two-way valve 15 is set to the hose side 3 and the water temperature is regulated by controlling the cold water tap 11 and the hot water tap 12 of the mixing water tap unit 1 under this condition, the user can take a pure water shower.

To use carbonated shower water, the user opens the gas through path 42 by means of the control valve 4. Then, carbon dioxide gas bursts out and becomes dissolved into shower water by way of the nozzle 46 so that the user now can take a carbonated water shower.

Figure 3:
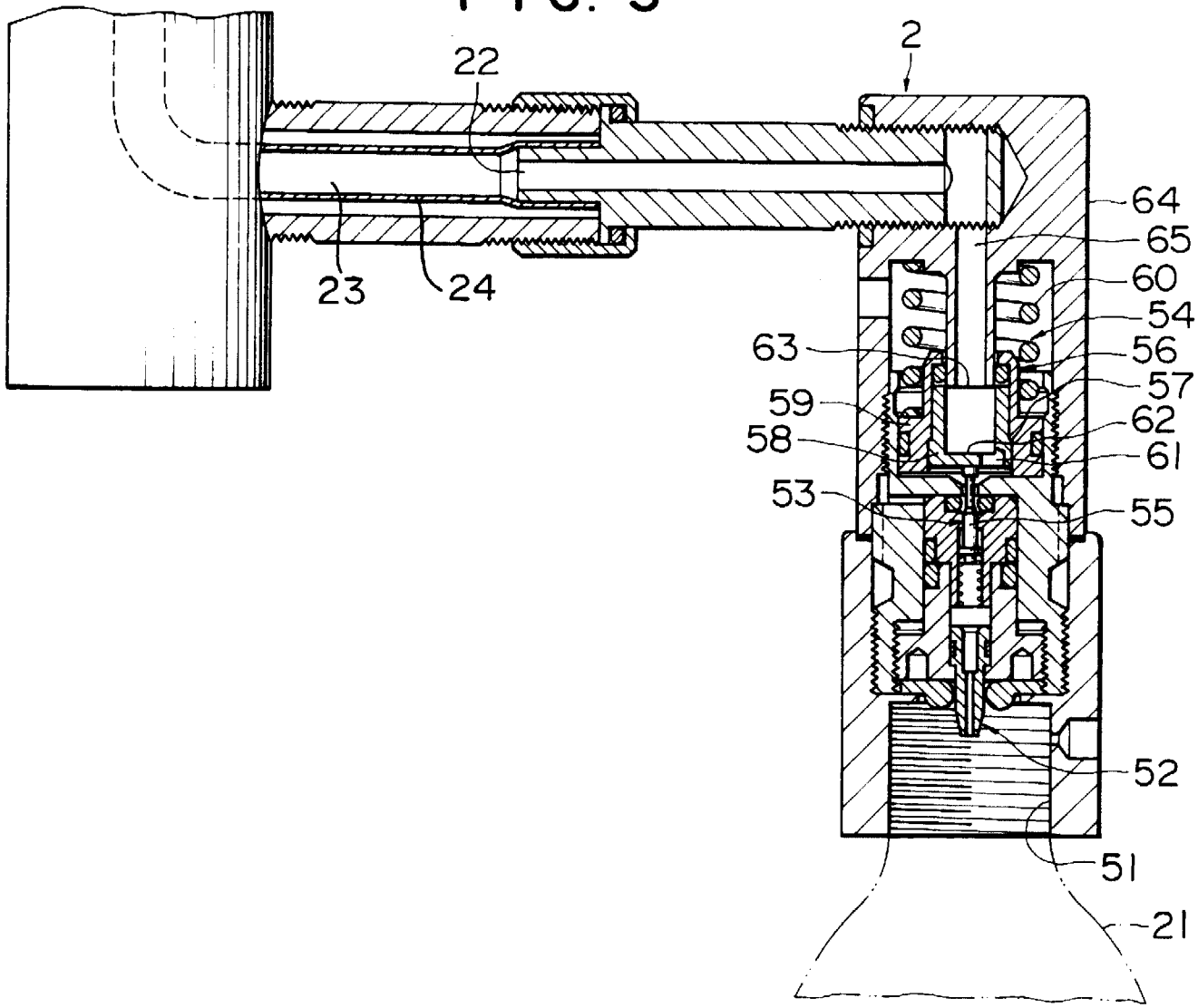
FIG. 3 is a cross sectional view of a carbon dioxide gas supply unit that can be used for the purpose of the invention.

FIG. 3 shows a possible configuration of the carbon dioxide gas supply unit. The carbon dioxide gas supply unit 2 has a fitting port 51 for a small gas cartridge 21, a closure opening device 52, a primary gas outlet mechanism 53 and a pressure reducing mechanism 54, all of which may be of an ordinary type.

The pressure reducing mechanism 54 has a piston 56 for actuating a valve pin 55 consisting of an inner cylinder 58 and an outer cylinder 59 designed to coaxially slide relative to each other within a limit defined by a stopper 57. The outer cylinder 59 is engaged with a pressure regulating spring 60. The inner cylinder 58 has at an end surface thereof an abutment section 62 for abutting the valve pin 55 located apart from a gas outflow hole 65 also arranged on the end surface and also has at the opposite end thereof an opening 63 constantly communicating with a gas passage 65 provided within a sleeve 64. The gas passage 65 communicates with the outlet port 65.

With the above arrangement, since the gas outlet port 22 can be disposed in an upper area of the sleeve 64 and the fitting port 51 of the cartridge 21 can be arranged below the mixing water tap unit 1, the cartridge 21 can be easily and removably fitted in position.

When the small tube 25 of the hose 3 is so designed as to be able to withstand the reduced pressure of carbon dioxide gas, pure water or carbonated shower water can be selected without any trouble and against the user's intention because no carbon dioxide gas would leak into the hose as long as the use of pure shower water is selected.

Figure 4:
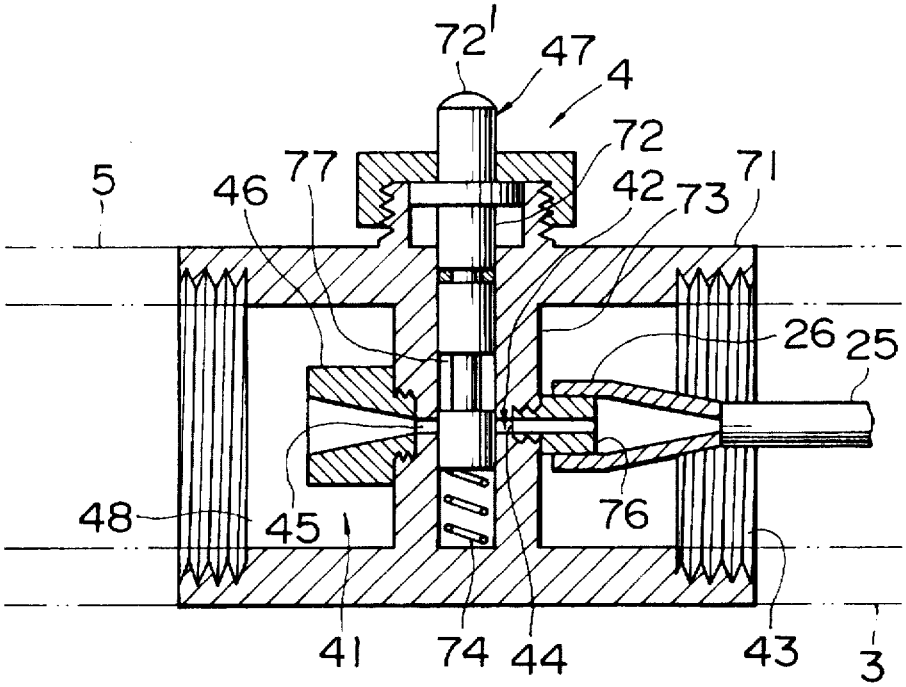
FIG. 4 is a partial cross sectional view of a control valve that can be used for the purpose of the invention.
Figure 5:
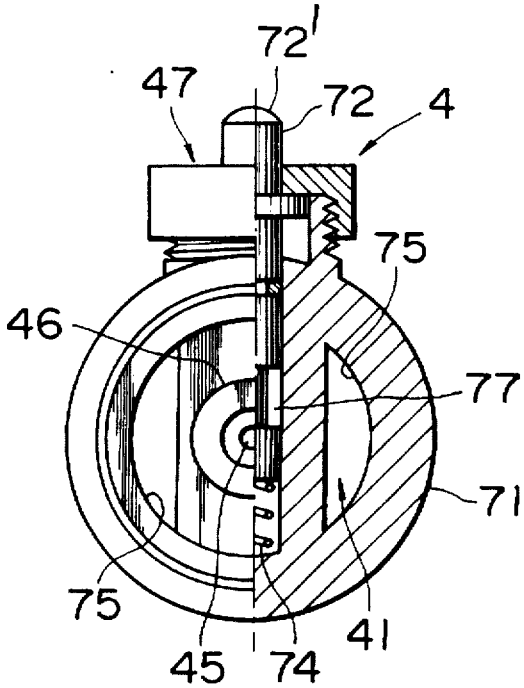
FIG. 5 is a partial cross sectional view of the control valve of FIG. 4, showing it from a different angle.

FIG. 4 is a partial cross sectional view of a control valve 4 that can be used for the purpose of the invention. FIG. 5 is a partial cross sectional view of the control valve 4 of FIG. 4, showing it from a different angle.

The valve section 47 includes a valve case 71, a valve rod 72, a cylinder 73 for slidably receiving the valve rod and a spring 74 disposed within the cylinder to urge back the valve rod. The cylinder 73 transverses a water through path 41 and maintains a gap 75 therein to allow water to flow therethrough, the gas through path 42 passing through the peripheral wall and the axis of the cylinder. The gas through path 42 is provided at an end 44 thereof with a fitting tube 76 and the other end 26 of the small tube 25 being fitted to the fitting tube, the nozzle 46 being fitted to the other end 45 of the gas through path. The outer end of the valve rod 72 projects from the valve case 71 to constitute a button section 72', the valve rod having a connecting section 77 within the valve case to be connected to and communicating with the gas through path 42 of the cylinder 73. With the above arrangement, the use of pure shower water can be easily switched to that of carbonated shower water or vice versa because the valve section 47 can be manipulated near the shower head 5.

Figure 6:
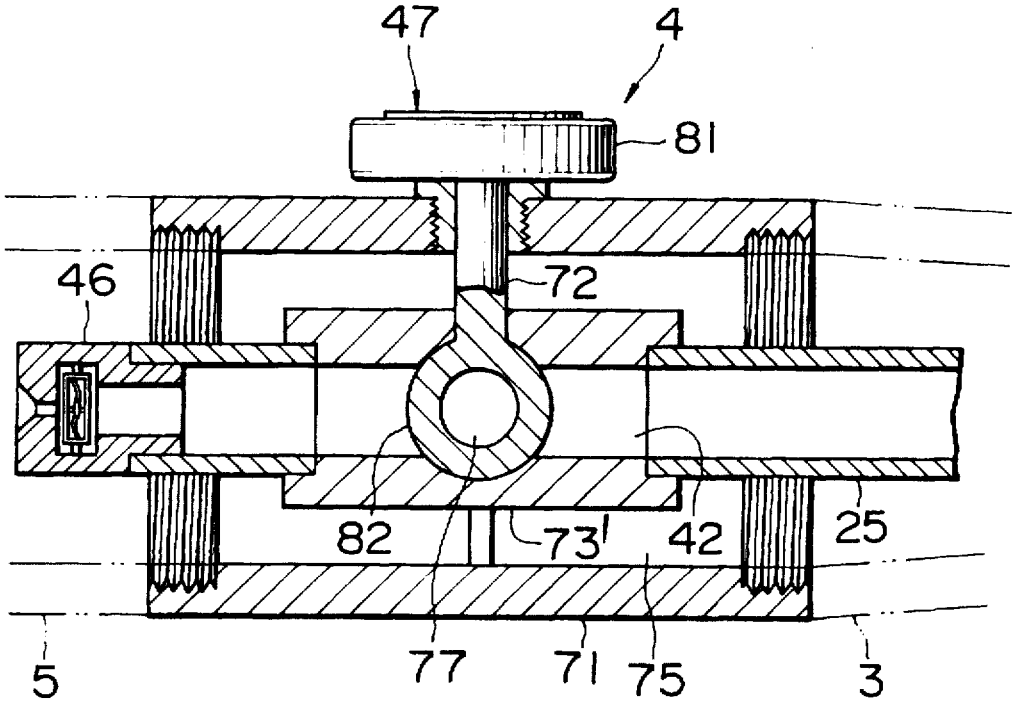
FIG. 6 is a partial cross sectional view of an alternative control valve that can be used for the purpose of the invention.

FIG. 6 is a partial cross sectional view of an alternative control valve 4 that can be used for the purpose of the invention.

The valve section 47 includes a valve case 71, a valve rod 72 and a cylindrical valve body 73'. The valve rod 72 is provided at the outer end thereof with a dial 81 and at the inner end thereof with a spherical body 82 having a connecting section 77 for opening and closing the gas through path 42, the spherical body being capable of revolving at a given position within the valve case 71. The cylindrical valve body 73' contains the gas through path 42 axially running therethrough and is disposed within the valve case 71 so as to maintain the gap 75 between the inner wall of the valve case 71 and itself to allow water to flow therethrough. The spherical body 82 of the valve rod 72 is revolvably contained in the valve case with the connecting section 77 disposed coaxially with the gas through path 42. With the above arrangement, the shower apparatus can be operated with ease because the dial 81 maintains its selected position if the user releases his or her hand from it.

[EXAMPLE]

In an experiment carried out for the purpose of the invention by using an apparatus according to the invention, four cartridges with capacities of 15 cc (12 g), 20 cc (15 g), 50 cc (40 g) and 95 cc (70 g) were used. The pressure reducing valve reduced the gas pressure to 2 kgf/cm2 on the secondary side when the gas flow rate was 10 Nl/min. The small tube had a diameter of 40 and was resistive against hot water. When the apparatus was used without depressing the valve rod, it supplied hot water at a specified rate between 10 and 15 liter/min. When the valve rod was depressed, the carbon dioxide gas in the small high pressure gas cartridge was made to burst out through the small tube and the nozzle under reduced pressure and dissolved well into water before carbonated hot water came out of the shower head in a jet stream.

The carbonate hot water showed a pH value between 5.2 and 5.5 and a carbon dioxide gas concentration of 100 to 200 ppm and flowed at a rate of 10 to 14 liter/min.

The 15 cc cartridge operated for about 2 minutes (which was a time good for 2 persons).

The 95 cc cartridge operated for about 12 minutes (which was a time good for 12 persons).

Thus, the apparatus proved that it could provides carbonated shower water at a cost lower than the cost of using a chemical agent that had been believed to be least costly. When the carbonated shower water flowing out of the shower head was collected in a bath tab, it served as a carbonated bath at low cost.

[Advantages of the Invention]

With a carbonated shower apparatus according to the invention, carbon dioxide gas under reduced pressure can be supplied simply by fitting a small high pressure carbon dioxide gas cartridge to the carbon dioxide gas supply unit of the apparatus. Since the cartridge is small, it does not practically occupy and additional space and can be handled with ease. Since a small tube disposed within the hose of an ordinary shower unit is used to feed carbon dioxide gas, the supply route of carbon dioxide gas also does not occupy any external space. The apparatus can be used to switch from pure water to carbonated shower water or vice versa simply by manipulating a control valve.

Carbonated water shower has the following effects.

(1) Bathing in carbonated water can promote blood circulation. (Munich University Report: 1984)

(2) Bathing in carbonated hot water can keep the body warm and has percutaneous effect including an enhanced oxygen content of blood (hemoglobin).

(3) When the hair is washed with water having a pH value of 7 to 8 (rinse water: tap water), the cuticle of hair expands to make the hair bulky. However, it is astringed quickly to make the hair bright and lustrous if water having a pH value of 5.2 to 5.5 is used. Carbonated water is also good for the scalp.

(4) Since carbonated water can be produced on site, it is efficient and economic.

(5) A minicartridge (95 cc) can serve for 12 persons. If carbonated shower water is collected in a bath tab, it is less costly than the use of a solid chemical agent for a carbonated bath.

(6) An apparatus according to the invention can be fitted to any existing shower unit.

According to the second aspect of the invention, the gas outlet port can be placed in an upper area of the sleeve and the cartridge fitting port can be arranged below the mixing water tap unit so that a cartridge can be easily and removably fitted in position to the carbon dioxide gas supply unit.

According to the third aspect of the invention, since the hose can withstand the reduced pressure of carbon dioxide gas, pure water or carbonated shower water can be selected without any trouble because no carbon dioxide gas would leak into the hose as long as the use of pure shower water is selected.

According to the fourth aspect of the invention, the use of pure shower water can be easily switched to that of carbonated shower water or vice versa because the control valve can be manipulated near the shower head.

According to the fifth aspect of the invention, the shower apparatus can be operated with ease because the dial maintains its selected position if the user releases his or her hand from it.

What is claimed is:

1. A carbonated shower apparatus comprising a mixing water tap unit, a carbon dioxide gas supply unit, a hose, a control valve and a shower head, characterized in that;

the mixing water tap unit and is connected to a cold water path and a hot water path by way of a cold water tap and a hot water tap, respectively, and to a water head and the hose to selectively communicate with said hose or said water head by way of a two-way valve, the carbon dioxide gas supply unit is arranged at the mixing water tap unit to take out gas from a small gas cartridge, reduce the gas pressure and send it out to a consumption side via an outlet port, the hose is connected at the base end thereof to the mixing water tap unit and contains therein a small tube having its base end connected to the outlet port, the control valve has a water through path and a gas through path, the water through path being connected at an end to the front end of the hose, the gas through path being connected at an end to the front end of the small tube and at the other end to a nozzle communicating with the water through path and provided at the middle thereof with a valve section, and the shower head is fitted to the control valve with a bore of said shower head communicating with the other end of the water through path.

2. A carbonated shower apparatus comprising a carbon dioxide gas supply unit having a fitting port for a small gas cartridge, a closure opening device, a primary gas outlet mechanism and a pressure reducing mechanism, with said pressure reducing mechanism further having a valve pin, an actuating piston with an inner cylinder and an outer cylinder which coaxially slides relative to each other within a limit defined by a stopper, the outer cylinder being engaged with a pressure regulating spring, and the inner cylinder having at an end surface thereof an abutment section for abutting the valve pin which is located apart from a gas outflow hole in the end surface of said inner cylinder, the inner cylinder also having at an opposite end thereof an opening constantly communicating with a gas passage provided within a sleeve and communicating with an outlet port.

3. A carbonated shower apparatus according to claim 1, wherein the small tube can withstand the reduced pressure of carbon dioxide gas.

4. A carbonated shower apparatus according to claim 1, wherein the valve section includes a valve case, a valve rod, a cylinder, having an axis, for slidably receiving the valve rod and a spring disposed within the cylinder to urge back the valve rod, the cylinder transversing the water through path and maintaining a gap therearound to allow water to flow therethrough, the gas through path passing through said cylinder across its axis and being provided at an end thereof with a fitting tube, the other end of the small tube being fitted to the fitting tube, and the nozzle being fitted to the other end of the gas through path, with the outer end of the valve road projecting from the valve case to constitute a button section within the valve case to be connected to and communicating with the gas through path of the cylinder.

5. A carbonated shower apparatus according to claim 1, wherein the valve section 47 includes a valve case, a valve rod and a cylindrical valve body, the valve road being provided at the outer end thereof with a dial and at the inner end thereof with a spherical body having a connecting section for opening and closing the gas through path, the spherical body being capable of revolving at a given position within the valve case, the cylindrical valve body containing the gas through path axially running therethrough and being disposed within the valve case so as to maintain the gap between the inner wall of the valve case and said cylindrical valve body to allow water to flow therethrough, and the spherical body of the valve rod being rotatably contained in the valve case with the connecting section disposed coaxially with the gas through path.

* * * * *